US008813979B2

(12) United States Patent
Wootten, Jr.

(10) Patent No.: US 8,813,979 B2
(45) Date of Patent: Aug. 26, 2014

(54) PRODUCT DISPLAY THAT ALLOWS CONSUMERS TO EXPERIENCE THE FEEL OF THE PRODUCT AND METHOD FOR DISPLAYING A PRODUCT

(75) Inventor: Gerald E. Wootten, Jr., Cullman, AL (US)

(73) Assignee: HomTex, Inc., Vinemont, AL (US)

( * ) Notice: Subject to any disclaimer, the term of this patent is extended or adjusted under 35 U.S.C. 154(b) by 112 days.

(21) Appl. No.: 13/017,330

(22) Filed: Jan. 31, 2011

(65) Prior Publication Data

US 2012/0037577 A1 Feb. 16, 2012

Related U.S. Application Data

(60) Provisional application No. 61/318,946, filed on Mar. 30, 2010.

(51) Int. Cl.
*A47F 7/16* (2006.01)

(52) U.S. Cl.
USPC ..... 211/45; 211/204

(58) Field of Classification Search
USPC ..... 211/45–49.1, 113, 118, 189, 191, 204
See application file for complete search history.

(56) References Cited

U.S. PATENT DOCUMENTS

| | | | | | |
|---|---|---|---|---|---|
| 938,854 | A | * | 11/1909 | Hawkins | 211/47 |
| 951,081 | A | * | 3/1910 | Kennett | 211/28 |
| 993,859 | A | * | 5/1911 | NMcCabe | 211/47 |
| 1,306,297 | A | * | 6/1919 | Auerochs | 211/10 |
| 1,378,692 | A | * | 5/1921 | Leffel | 211/47 |
| 1,706,069 | A | * | 3/1929 | Marquardt | 211/46 |
| 2,087,149 | A | * | 7/1937 | Hendrix | 211/162 |
| D134,111 | S | * | 10/1942 | Bersin et al. | D6/410 |
| 2,830,708 | A | * | 4/1958 | Miller | 211/120 |
| 2,851,167 | A | * | 9/1958 | Rosenberg | 211/46 |

(Continued)

FOREIGN PATENT DOCUMENTS

| | | |
|---|---|---|
| DE | 8005695 | 6/1980 |
| DE | 8005696 | 6/1980 |

OTHER PUBLICATIONS

Photographs taken at a retail store in the United States on Jan. 27, 2010 of a Display Stand.

(Continued)

*Primary Examiner* — Korie H Chan
(74) *Attorney, Agent, or Firm* — Medley, Behrens & Lewis LLC; Lorri W. Cooper

(57) ABSTRACT

A product display unit for providing the consumer with an opportunity to position a major part of the body against the product being displayed includes a stand that has a height, a length, a top, and a bottom. A plurality of products are coupled in the vicinity of the top of the stand. The plurality of products are spaced from one another along the length of the stand. The stand has a height that allows the consumer to position a major part of the body below the top of the stand adjacent the products such that the consumer can feel the products being displayed. A method for providing a consumer with the touch and feel of an article utilizing a display unit includes providing a display unit that includes a stand, hanging a plurality of products from the stand, and allowing the consumer to position a major portion of their body against the products in order to determine what the product would feel like in use.

21 Claims, 8 Drawing Sheets

(56) References Cited

U.S. PATENT DOCUMENTS

| | | | | | |
|---|---|---|---|---|---|
| 3,217,893 | A | * | 11/1965 | Fleischman | 211/94.02 |
| 3,871,524 | A | | 3/1975 | Helf | |
| 3,905,480 | A | * | 9/1975 | Grinceri | 211/45 |
| 3,913,995 | A | * | 10/1975 | Malcik et al. | 312/183 |
| 4,685,573 | A | * | 8/1987 | Ovitz, III | 211/46 |
| 4,907,706 | A | * | 3/1990 | Henderson | 211/46 |
| 6,308,842 | B1 | * | 10/2001 | Robbins et al. | 211/113 |
| 2008/0023418 | A1 | * | 1/2008 | Robbins | 211/45 |
| 2008/0250679 | A1 | * | 10/2008 | McNamee | 40/124.2 |

OTHER PUBLICATIONS

Office Action issued Aug. 3, 2012 in corresponding Canadian Patent Application No. 2,730,988.

* cited by examiner

54

PRODUCT DISPLAY THAT ALLOWS CONSUMERS TO EXPERIENCE THE FEEL OF THE PRODUCT AND METHOD FOR DISPLAYING A PRODUCT

CROSS-REFERENCE TO RELATED APPLICATION

This application claims priority to U.S. Provisional Patent Application No. 61/318,946, filed Mar. 30, 2010, the disclosure of which is hereby incorporated by reference in its entirety.

FIELD

This technology relates to a display unit for displaying products. In particular, the technology is useful in the bedding industry and allows consumers to place parts of their body against the fabrics that would typically be used in bedding by hanging the bedding in long swatches from a display. The technology can also be used in other industries, not limited to the bedding industry.

BACKGROUND

Swatch hanging devices have been known. Rings have been used to hang swatches from a display stand in a bunch. For example, a plurality of fabric samples have been hung from a large ring, with grommets coupled to a top end of the fabric samples and the ring extending through the grommets. Swatches have also been hung by hangers from an integral part of a product shelving device. These swatches are often small. It is difficult for the consumer to determine what it would feel like to use these materials in a bedding article.

SUMMARY

An example display unit for displaying a plurality of products is shown and described.

BRIEF DESCRIPTION OF THE DRAWING FIGURES

DETAILED DESCRIPTION

The example display unit 10 is for use in displaying fabric swatches 12 to a consumer. The fabric swatches have a substantial length L1 compared to prior art fabric swatch displays. The display unit 10 is unique in that it allows the consumer to experience the feel of the fabric, including the texture, softness, firmness, and other fabric qualities, in a manner that mimics real use. This occurs by providing a display unit 10 that has a height H that allows the consumer to position a major part of their body against the fabric swatches 12. Because of the length L1 of the swatches, the consumer gets the feel of being immersed in a cloud of fabric. One example display unit 10, as shown in the figures, is taller than an average person's height. As a result, a consumer can position part or all of their body against the fabric 12 to experience the feel of the fabric as if they are lying in bed. The consumer also gets to experience the movement of the fabric 12 against their bodies. This type of experience was previously not provided by display units.

Figure 1:
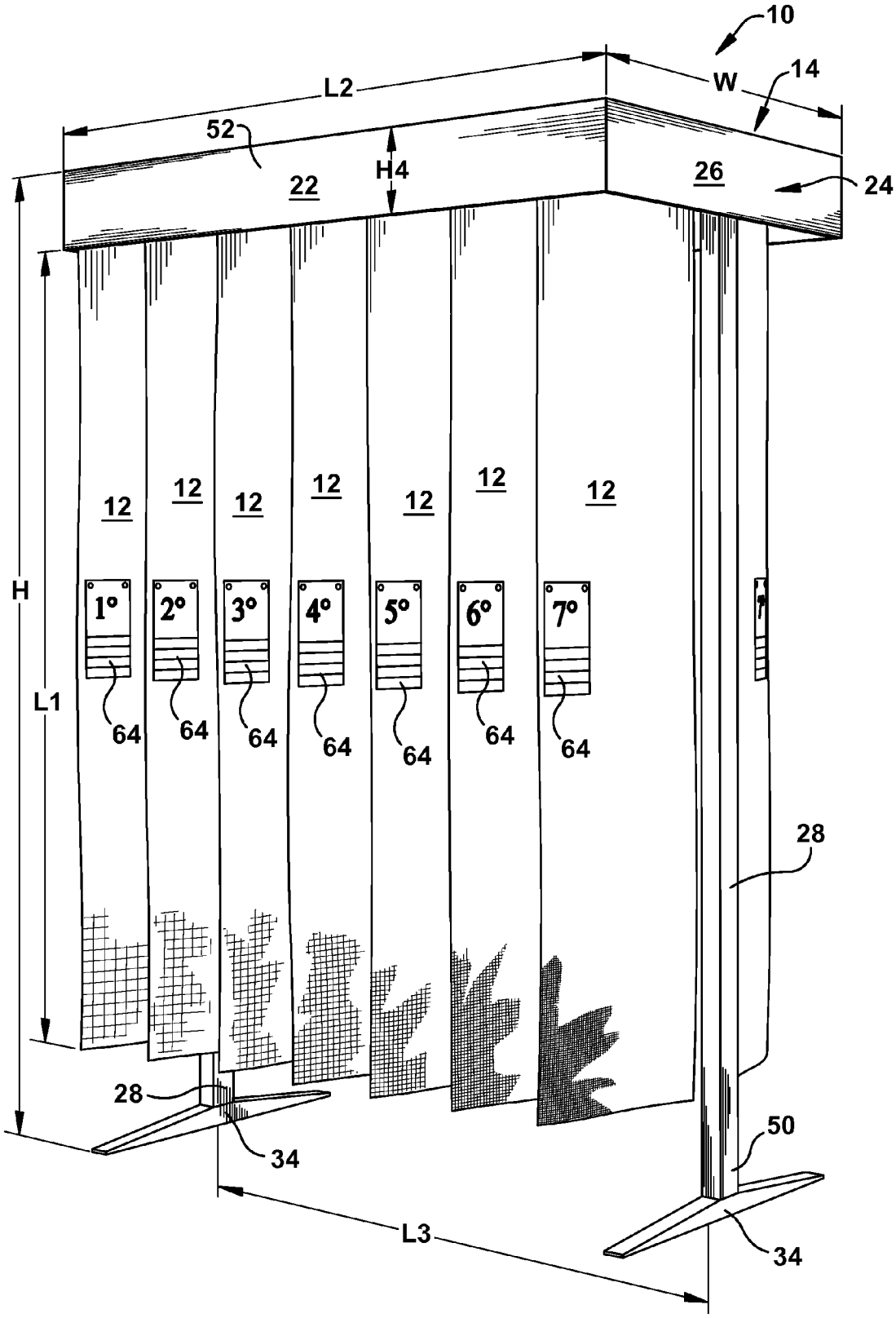
FIG. 1 is a perspective view of an embodiment of the example display.
Figure 2:
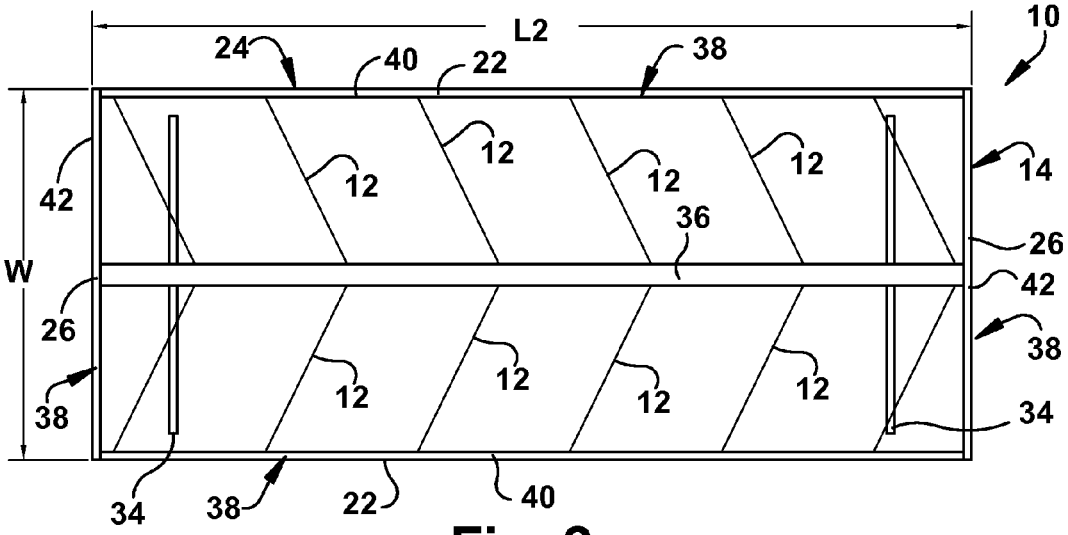
FIG. 2 depicts a top view of an example display showing fabric swatches hanging from the display.
Figure 3:
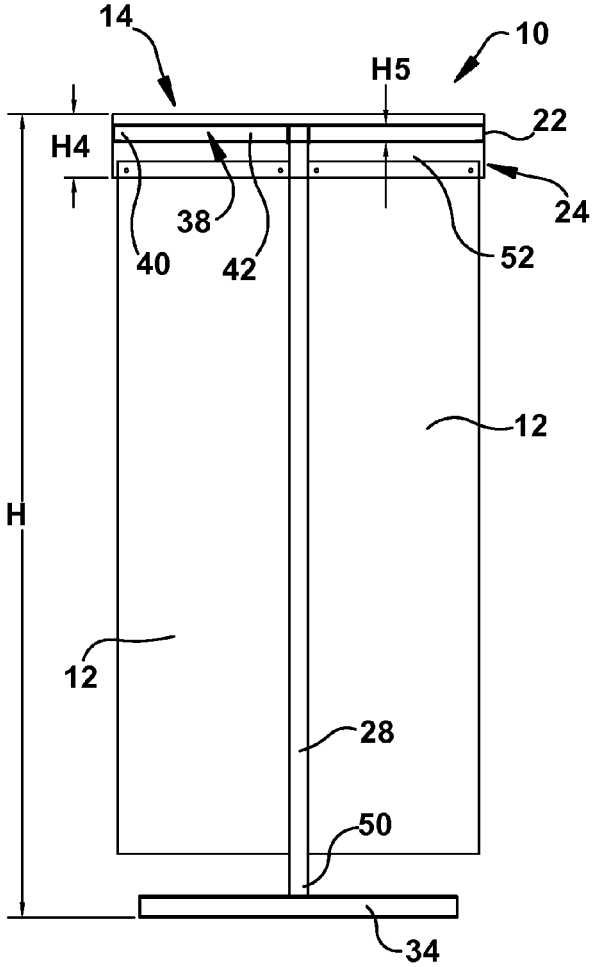
FIG. 3 depicts an end view of the example display of FIG. 2.
Figure 4:
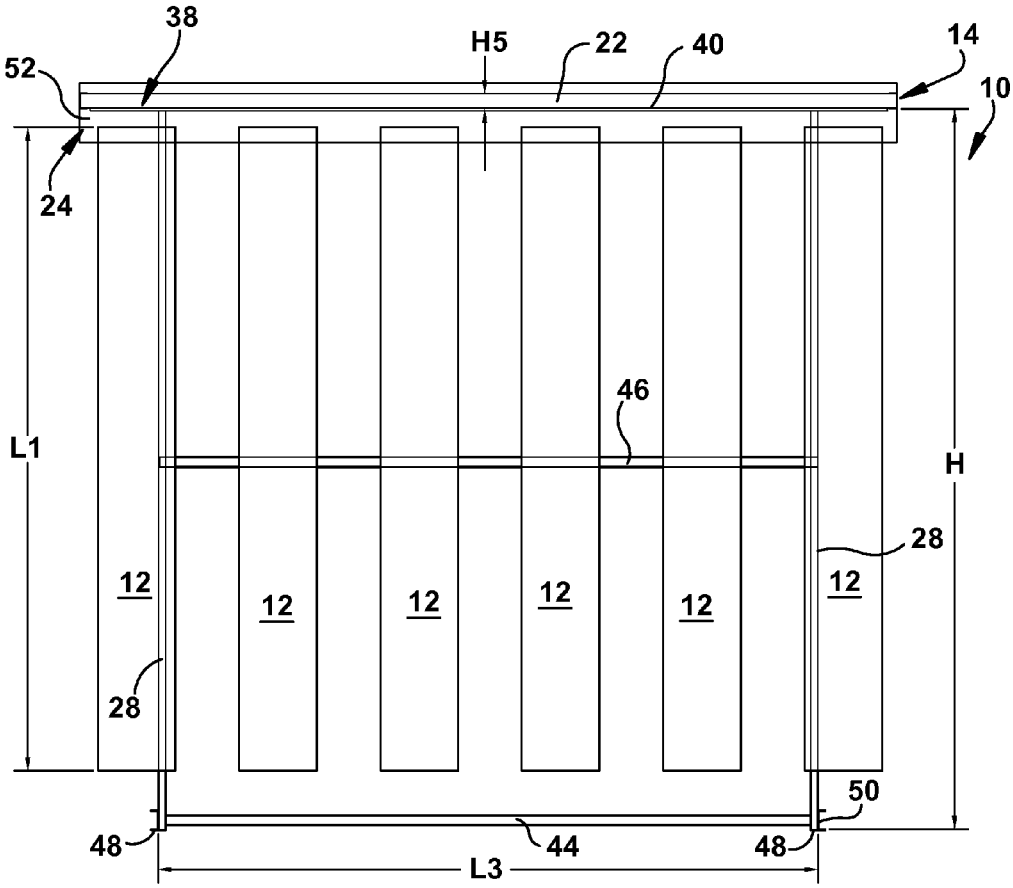
FIG. 4 depicts a side view of the example display of FIG. 2.
Figure 7:
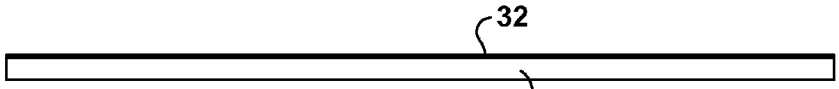
FIG. 7 depicts a top view of the alternative foot design shown in FIG. 5.
Figure 8:
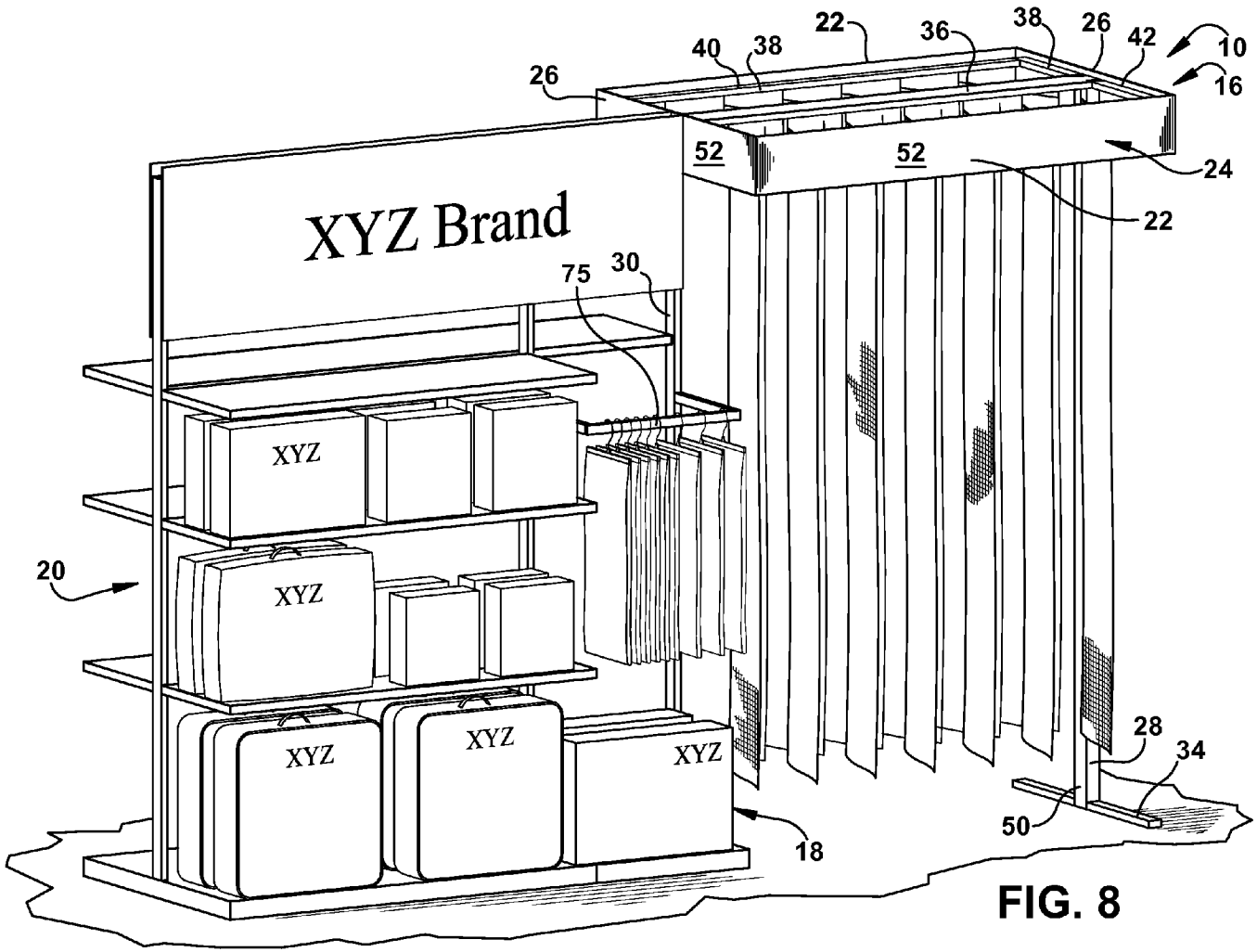
FIG. 8 depicts a perspective view of an alternative example display shown attached to a conventional product stand.
Figure 9:
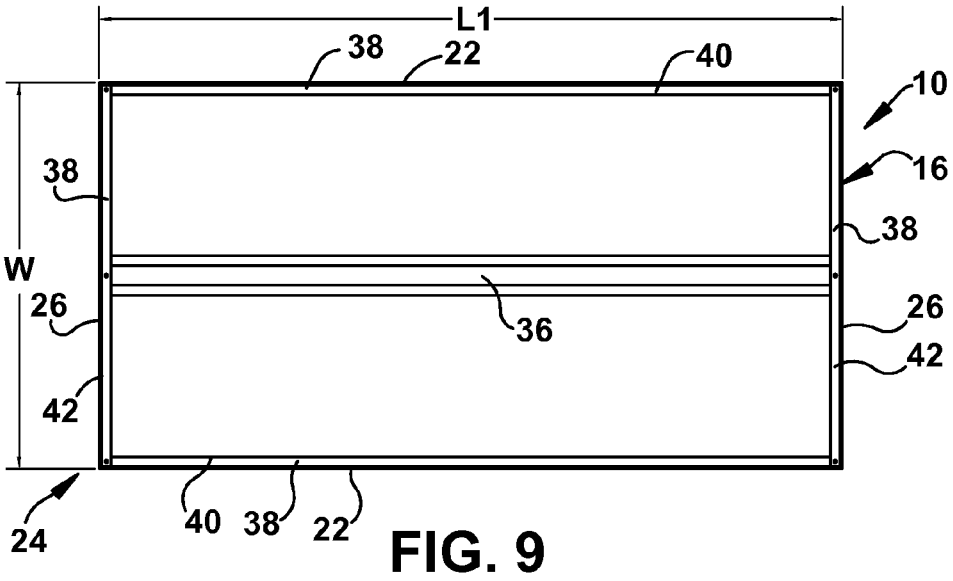
FIG. 9 depicts a top view of the example display shown in FIG. 8.
Figure 10:
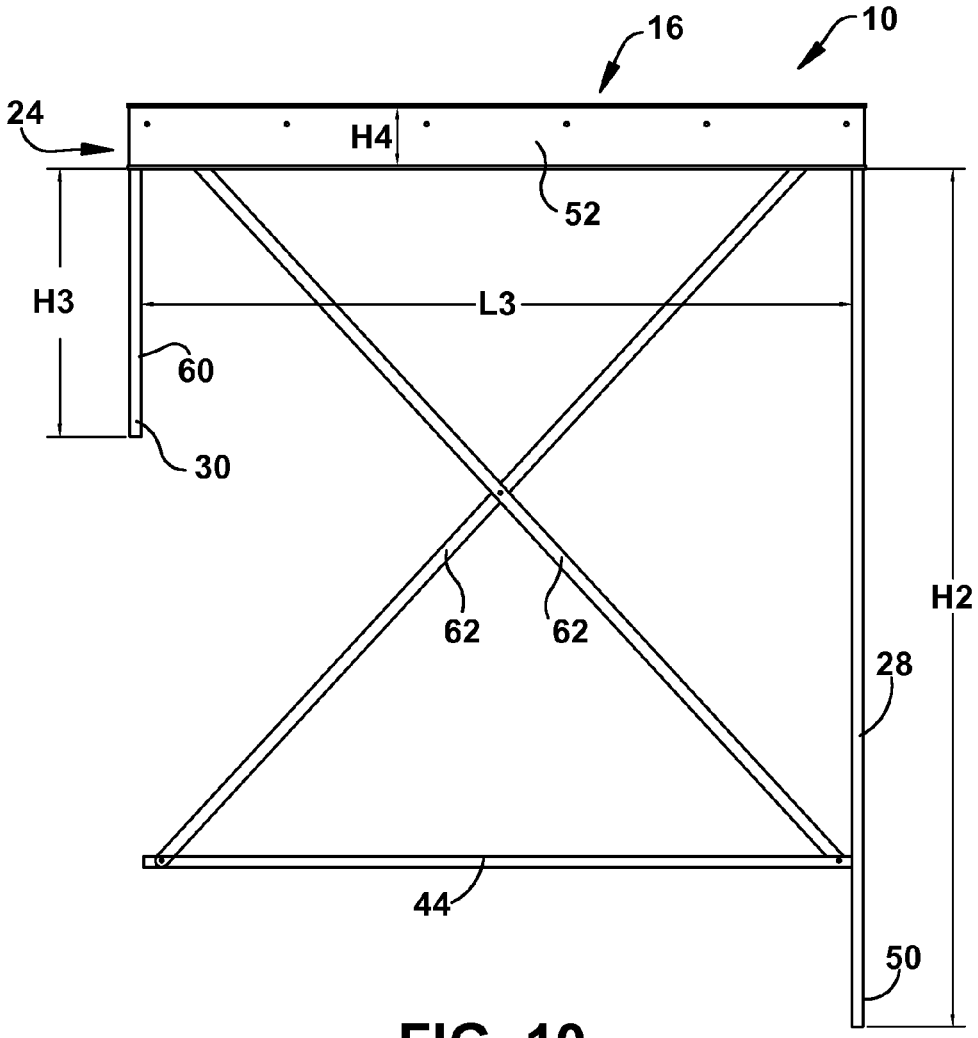
FIG. 10 depicts a side view of the example display shown in FIG. 8.
Figure 11:
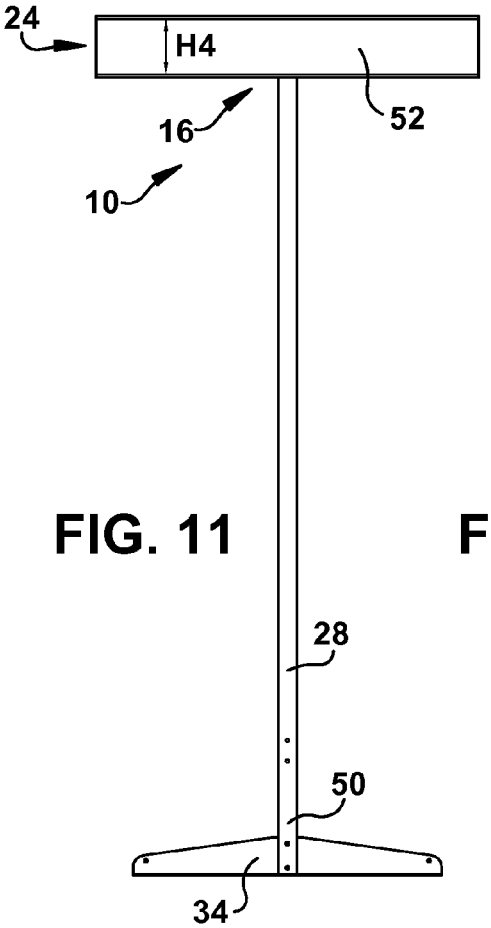
FIG. 11 depicts an end view of the example display shown in FIG. 8, as viewed from the right side of FIG. 10.
Figure 12:
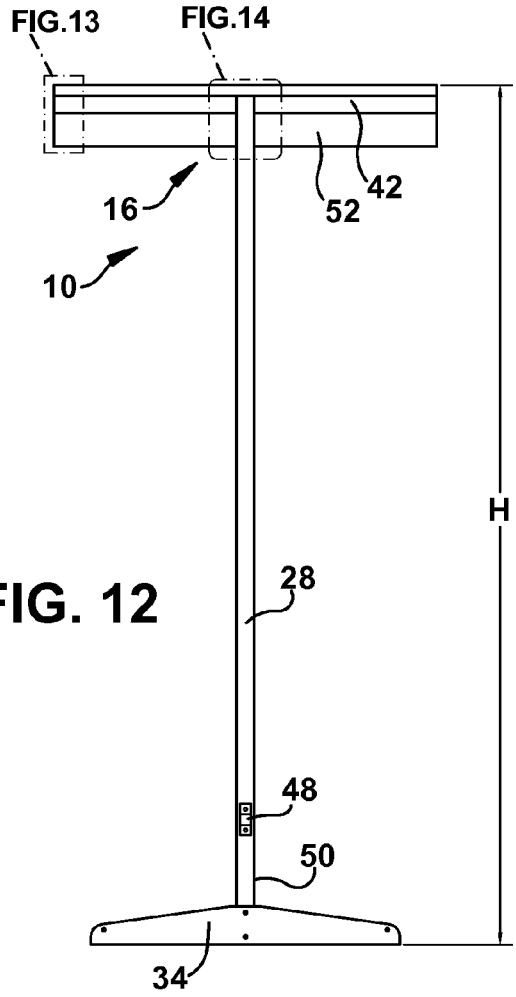
FIG. 12 depicts a plan view of the example display shown in FIG. 8, as viewed from the inside of the right end shown in FIG. 10.
Figure 13:
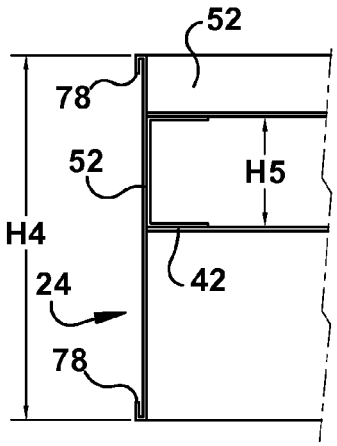
FIG. 13 depicts a cross-sectional view of the C-channel shown in FIG. 8, as taken at 13 in FIG. 12.

The display unit 10 may be a stand along unit 14, as shown in FIGS. 1-7, or an add-on unit 16, as shown in FIGS. 8-14. The add-on unit 16 may be added to an end cap 18, or to another location, on an existing display unit 20 that is separate from the example display unit 10. Any type of display unit 10 may accept this add-on unit 16, including a shelving unit 20, as shown in FIG. 8.

In one example of the display unit 10, the display unit 10 has a height H of about 6 feet 3 inches so that most female consumers and many male consumers are permitted to position their body, including their faces, against the fabric swatches 12. Another display unit 10 may be about 4 feet tall such that a consumer can position parts of their arms or legs against the fabric swatches 12. Other heights may also be utilized, including about 3 feet, 4 feet, 5 feet, 6, feet, 7 feet, 8 feet and heights greater or less than those heights including increments between those heights H.

The display unit 10 shown in the Figures has two sides 22 in order to maximize the amount of fabrics that are displayed. This type of device would do best positioned away from the wall in order to allow a consumer to walk around the unit 10. Another device may include swatches 12 on only one side of the display unit 10 (not shown), such that the unit 10 may be placed against a wall, if desired. Other units 10 may have multiple rows of fabric swatches 12, such as 3 or 4 rows or more (not shown). The display unit 10 can be designed so that a consumer can actually walk through the fabric swatches 12 in order to provide a cloud-like feeling, such as may be associated with dreaming.

The fabric swatches 12 are spaced apart from one another in order to give the consumer room to try the various fabrics. Prior art devices often had the swatches on hangers or rings 75 (shown in FIG. 8) and the fabrics were packed closely together. In the example display unit 10, the swatches may be removably fixed to the display unit 10 so that the consumer cannot easily remove them. This advantageously results in fewer losses of the samples. However, even though the swatches 12 may be maintainable in spaced relation during display, the swatches 12 are also removable from the display unit 10 in order to replace and/or periodically launder them.

The display unit 10 also may include advertising displays 24, such as the head caps, or header units 24, shown in the Figures. These head caps 24 can be used to provide product information, advertising material, or other information, if desired. An electronic device could be coupled to the header unit, if desired, such as an LED display or a Television Screen for playing movies or advertisements (not shown). The header unit 24 may cover the underlying structure of the display unit 10 in order to provide a more aesthetically pleasing appearance. Other places on the display unit 10 may also be utilized for purposes of displaying product information and/or advertising, such as the end caps 26 or the upright support posts 28, 30.

The display unit 14 shown in FIGS. 1-4 may be positioned next to product shelving (not shown) in a retail environment, such that the consumer may experience the feel of the samples 12 and then purchase the product in the closely located product shelving. In one example, product shelving can be positioned on either end 26 of the display unit 14 and the product shelving may have two sides or a single side housing packaged products. This shelving may be integral with the display unit, or stand alone 14. If it often desirable to position the actual product in close proximity to the example display unit 14 such that once the consumer decides upon a particular fabric, he or she can readily select a corresponding set of bedding.

Referring to FIGS. 1-4, a display unit 14 is a stand that has a height H, a length L2 and a width W. A first upright 28 is positioned at one end of the stand and a second upright 28 is positioned at the opposite end of the stand. The uprights 28 may be C-channels for added stability. A foot 34, 54 may be positioned at the bottom 50 of each upright 28, 30. The foot 34, 54 may also be a C-channel.

A header unit 24 is a rectangular unit that is coupled to the uprights 28, 30. The header unit 24 includes a center support 36 and outer supports 38. The outer supports 38 include two side supports 40 and two end supports 42 that are coupled together at the corners. The header unit 24 has a length L2 that is greater than the length L3 between the uprights 28, 30. The center support 36 may be a U-channel or hat channel. The outer supports 38 may be C-channels. Other types of supports may also be used. The length L2 of the header unit 24 may alternatively be substantially the same as the length L3 between the uprights.

A bottom cross-brace 44 and a center cross-brace 46 extend between the first and second uprights 28. The cross-braces 44, 46 may be tubes, such as 1" tubes. The stand shown has a first side 22 and a second side 22 for displaying fabric swatches 12. The fabric swatches 12 are shown being hung from the header unit 24 and angled relative to the uprights 28. The fabric swatches 12 extend between the center support 36 and the side supports 40 and are spaced apart from one another.

Instead of the single center cross-brace 46, cross-brace straps 62 may be utilized in an X-pattern between the bottom cross-brace 44 and the center support 36 of the header unit 24. The uprights 28 have connection points or brackets 48 for joining with the cross-braces 44, 46, 62. The bottom cross-brace 44 is spaced from the bottom 50 of the stand.

A header placard 52 may be attached to the header unit 24 and may extend around all the outer supports 38 in order to hide the support 38 of the header unit 24. The header placard 52 may be a foam board, a metal sheet, or another material and may be utilized for displaying advertising or product information, among other information. The header placard 52 may include a flat receiving member that has channels on an upper and lower end thereof, and an advertising material may be slid into the channels. The header placard 52 could be plastic or metal, if desired. The header placard 52 may have any desired shape. The header unit 24 may have channels 78 that allow the header placard 52 to slide into place. The header placard 52 may be removable, if desired, or fixed. It may be rectangular or have a varied shape.

In addition, an electronic display may be coupled to the header unit 24 (not shown) and integrated into the header placard 52, if desired, to provide additional electronic media to a consumer. An electrical line is incorporated into the structure of the stand to provide an electrical input to the electronic display.

Figure 6:
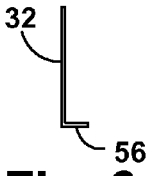
FIG. 6 depicts an end view of the alternative foot design shown in FIG. 5.
Figure 5:
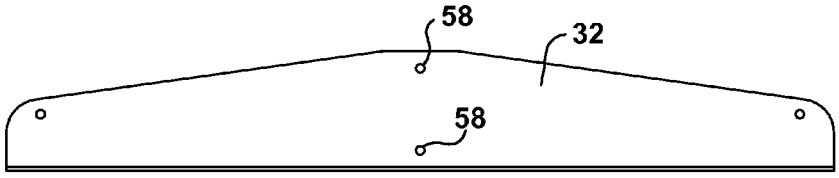
FIG. 5 depicts an alternative foot design for the example display shown in FIG. 2.

FIGS. 5 to 7 depict an alternative foot design. In this example, the foot is an L-bracket, with the lower L-portion 56 of the foot 54 extending inwardly and the upright portion of the "L" 32 of the foot 54 being the upward standing, outer surface of the foot 54. The foot 54 may be coupled to the uprights 28 using screws or other fasteners (not shown). Holes 58 may be provided through the foot in order to accept screws or other fasteners.

FIG. 8 shows an example add-on unit 16 that can be attached to an end cap 18 of an existing shelving unit 20 or other display unit. The add-on unit 16 provides an upright 30 that can be attached to an existing product display 20, and a foot 34, 54 and upright 28 that supports the opposite end of the display unit 16. FIGS. 9-14 show the various individual parts of the display unit 16 shown in FIG. 8.

Referring to FIGS. 9-14, the add-on unit 16 of FIG. 8 has a height H, a length L2, and a width W. The add-on unit 16 includes a header unit 24, a first upright 28 positioned at one end, and a second upright 30 positioned at the opposite end. The first upright 28 has a first height H2 and the second upright 30 has a second height H3 that is less than the first height H2. The objective of this height difference is to allow the shorter, second upright 30 to be attached to a stand-alone product shelving unit 20 at a height that is above the floor, so that the add-on unit 16 appears to be an integral, original part of the product shelving.

The add-on unit 16 also includes one or more cross-braces 44, 62 and supports 36, 40, 42. A foot 34, 54 is positioned at one end of the unit 16 for assisting in maintaining stability of the unit 16. While any variety of parts may be used to construct the unit 16, a specific example is taught herein for example purposes.

The header unit 24 includes a centrally extending support member 36 and two side supports 40 that extend parallel to and spaced from the center support 36. End supports 42 are coupled to each of the side 40 and center supports 36 to form a rectangular header unit 24. The center support 36 may be a "U" or hat channel and the side and end supports 40, 42 may be "C"-channels. Other types of supports may also be used.

An advertising placard or strip 52 may be coupled to the side and end channels 40, 42 to provide greater surface area for displaying advertising. The header strips 52 preferably have a height H4 that is greater than the height of the center, side, and end channels. The header strips 52 may be coupled to the side and end channels 40, 42 with fasteners, such as screws. Holes may be provided through the header strips 52 and channels 40, 42. Alternatively, the header strip 52 may be welded or otherwise associated with the supports 40, 42.

Figure 14:
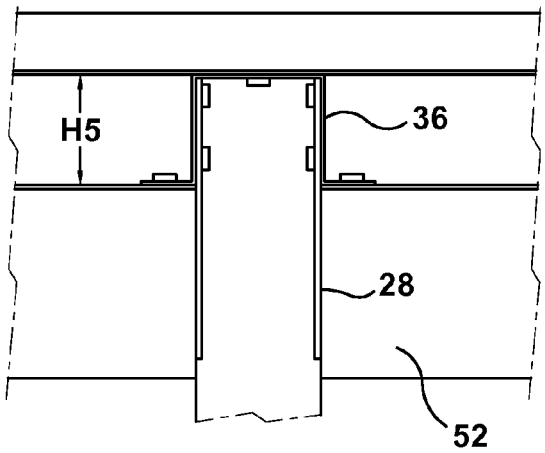
FIG. 14 depicts a cross-sectional view of the hat channel shown in FIG. 8, as taken at 14 in FIG. 12.

The first upright 28 is coupled to the center support 36, which has a downwardly facing opening so that the uprights 28, 30 can slide into the opening, shown best in FIG. 14. The side and end supports 40, 42 may be C-shaped channels that provide additional support to the header strips 52, shown best in FIG. 13. The uprights 28, 30 may include connection points 48 for connecting with the cross-braces 62 or cross-supports 44, 46.

The stand may include a cross-support or cross-tube 44 that extends from one end to the other end at the bottom 50 of the stand. The cross-tube 44 is coupled to the first upright 28 at the connection point 48. Cross-bracing straps 62 may be coupled to the cross tube 44 at either end thereof and extend from the cross-tube 44 up to the center support 36, end supports 42, or uprights 28, 30. Two cross-bracing straps 62 are shown in a crossing pattern.

A foot 34, 54 may be coupled to the bottom of the first upright 28. An example foot is shown in FIGS. 5-7. Other foots may also be utilized.

Fabric swatches 12 may be hung between the side supports 40 and the center support 36 of the header unit 24. Metal or plastic rings 70 may be used to connect the fabric swatches 12 in spaced relation. Indents (not shown) may be provided on the channels 36, 40 in order to provide a seating spot for the rings or pear clips 70. As one alternative, plastic or other strapping or string may be used to attach the fabric swatches 12 to the side 40 and center supports 36. Holes 74 may extend through the supports 36, 40 for accepting rings or other fasteners 70.

Other designs may be used for the add-on display unit 16—the objective being to provide the consumer with the ability to sample the feel of the fabrics, or to obtain an overall greater impression of the materials being displayed. For example, other attachment designs/techniques may be used with or without an upright. Any type of fastener or fastening technique may be utilized to join the add-on unit 16 to another display. Any type of fasteners may be utilized with fabric swatches 12 in order to hang them from the product display unit 14, 16.

Figure 15:
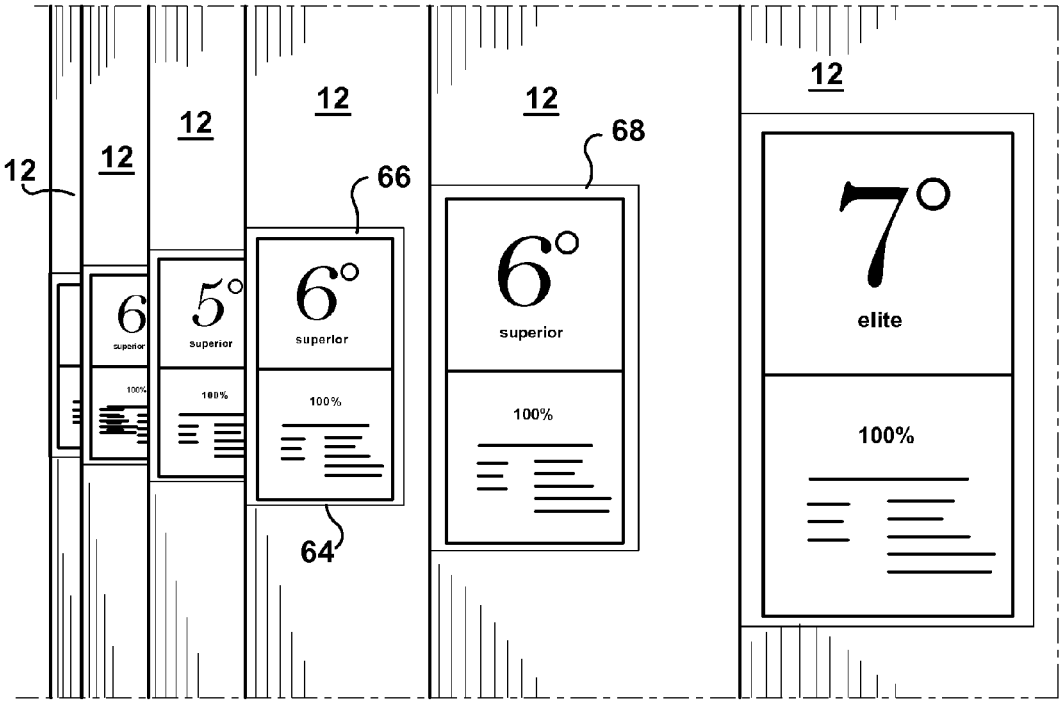
FIG. 15 depicts a plurality of pockets attached to the hanging fabric swatches shown in FIG. 1.
Figure 16:
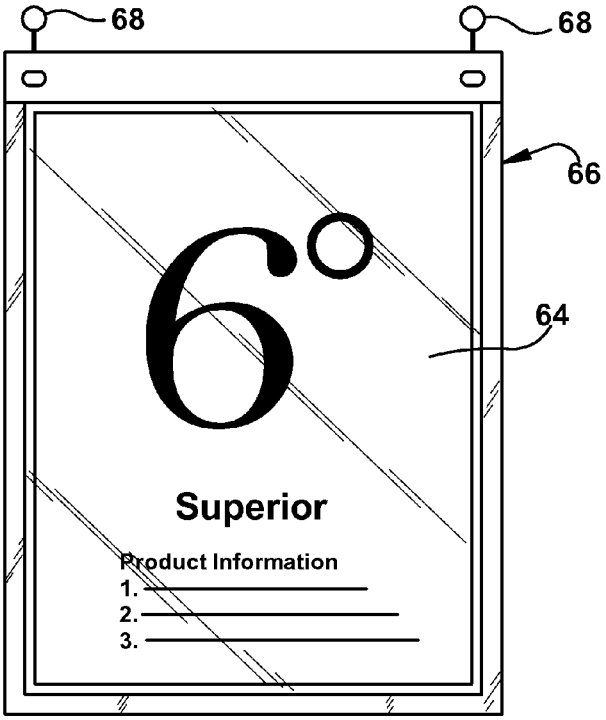
FIG. 16 depicts one example of an example pocket from FIG. 15 used to hold information about the fabric being displayed.

FIGS. 15 and 16 show how a display card 64 can be positioned on the fabric swatches 12. The display card 64 can be used to provide a product description, advertising material, or any other wording or pictures, as desired. The example shown in the figures includes attaching a plastic pocket or sleeve 66 to the fabric utilizing plastic tag fasteners 68. Other types of fasteners may alternatively be utilized. The plastic tag fasteners are easy to apply with the proper tools. It is desirable to be able to periodically launder the fabric swatches 12. A cardboard, paper, or other type of card 64 may be slid into the pocket 66. Since the plastic pocket 66 is made of a transparent material, information printed on the card 64 is visible to a consumer.

As consumers position parts of their bodies against the swatches 12, the swatches may become soiled. The use of plastic tag fasteners 68 and the pocket cards 64, 66 makes it easy to remove the pocket cards 64, 66 such that the swatches 12 may be removed from the display 14, 16 for laundering purposes and then easily reapplied. Other types of coupling mechanisms or display cards may also be utilized, the example product display 14, 16 not being limited to the example shown. For example, plastic pockets could be glued or sewn to the fabric swatches. Alternatively, instead of having plastic sleeves, cardboard or paper tags could be attached without the sleeves 66 using tag fasteners or other fasteners.

Other techniques may also be used for displaying fabric swatch product information. For example, a long display card or sheet (not shown) may be hung simultaneously with each fabric swatch 12 utilizing the same fasteners that are used for hanging the swatch. In this example, the display cards could be shorter in length than the fabric swatches 12 so that they would not interfere with the consumer's ability to test the fabric against their bodies. In one example, the display cards could be anywhere from 8 inches to 2 feet in length. They could also be shorter or longer in length. Alternatively, display cards could be hung from the display unit 14, 16 and intermixed with the fabric swatches 12 so that the swatches 12 are spaced a distance from the display cards in succession such that a display card is positioned adjacent a swatch, which is positioned next to another display card and another swatch, etc.

Any type of material may be utilized with the examples depicted herein that are known to those of skill in the art, including a variety of plastic and metal materials, among other materials. For example, the display unit 10 may be made from stamped steel, aluminum, steel, hard plastic or any rigid material. Any known manufacturing method may be utilized to make the various parts that are shown. Many different types of fasteners may be utilized, such as screws, welds, pem nuts and studs, fasteners, and clips.

Products other than fabric swatches 12 may be utilized with the display unit 10. All types of bedding material may be displayed, including sheets, mattress pads, comforters, blankets, and the like.

Things other than bedding material may also be displayed. For example, the display unit 10 could be used for displaying clothing fabric in a sales setting so that a buyer could try out the fabric without having to try on the clothing. The display unit 10, while described in the context of the bedding industry, may be utilized in any industry desired and may be used for displaying many different types of products. For example, the building industry might find the example display unit 10 helpful for displaying siding or roofing samples, among many other alternatives. In the case of the display of heavier articles, the various parts of the display unit 10 would be adjusted to support the greater weight.

Figure 17:
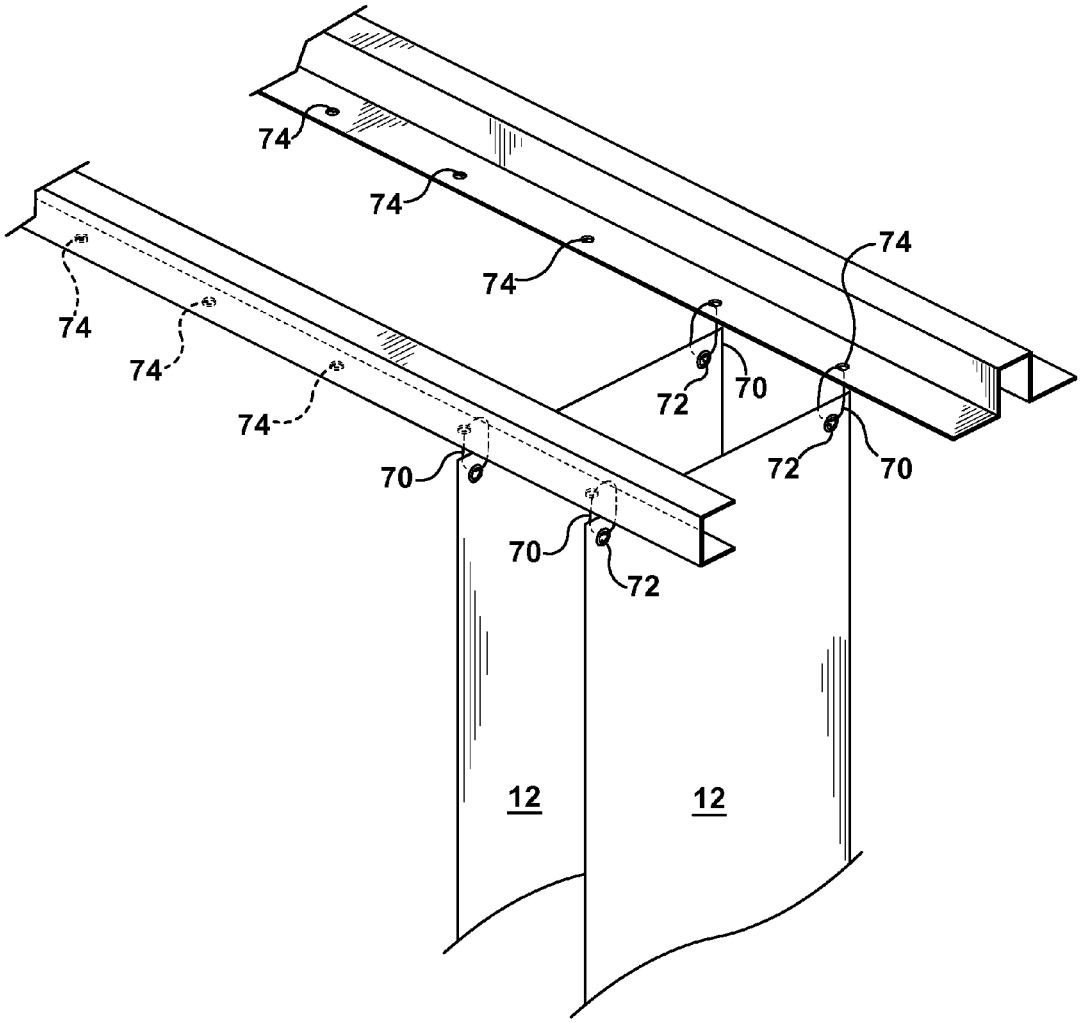
FIG. 17 depicts a perspective view of one example of a way by which fabric samples may be coupled to the display unit in spaced relation to one another.

The fabric swatches 12 may be connected to the display unit 10 using any known technique, such as shown in FIG. 17. One example includes using pear clips 70 and grommets 72. The grommets 72 are positioned on the fabric swatches 12 at opposite sides of the top end of each swatch of fabric 12. Pear clips 70 are inserted through the grommet 72 and through holes 74 that are positioned in the display unit 10 support members 36, 40. The holes 74 may be positioned through horizontal portions of the header center support 36 or elsewhere. In the example shown, the center support hat channel 36 has horizontal flanges that are provided with through holes 74 for accepting the pear clips 70. The side supports 40 are C-channels with horizontal flanges having holes 74 therethrough for accepting the pear clips 70 so that the fabric swatches 12 may be hung between the center 36 and side supports 40. Any orientation of the fabric swatches 12 may be used for hanging the swatches, such as the angled orientation shown (where the swatches are not perpendicular to the center support 36), or another orientation, such as being perpendicular to the center support 36.

Other types of fasteners may also be utilized, including chains, rods, cable/zip ties, rings, and other fasteners. In some instances, such as with the use of chains or rods, it is beneficial to provide a hemmed section at the top of the fabric swatch 12 so that the chain or rod can slide through the hem. Alternatively, a series of grommets can be spaced across the top end of each fabric swatch 12 in order to accept the chain or rod. Any type of fastener or fastening technique can be utilized, the invention not being limited to that shown or described, as known by those of skill in the art.

The fabric swatches 12 may hang straight down, or could be waterfalled (not shown) so that the swatches resemble blinds, such as roman shades. This can occur using similar techniques to those used for roman shade manufacture.

Several example constructions for a display unit are shown herein. Other constructions may alternatively be utilized. Any type of display stand may be designed as long as it permits a consumer to position a major part of their body against the fabric swatches 12, or displays a major portion of a product for the consumer to view and feel.

A product display unit 10 for providing the consumer with an opportunity to position a major part of the body against the product being displayed includes a stand and a plurality of products 12 coupled to the stand. The stand has a height H, a length L2, a top, and a bottom 50. The plurality of products 12 are coupled in the vicinity of the top of the stand in spaced relation from one another along the length L2 of the stand. The stand has a height H that allows the consumer to position a major part of the body below the top of the stand and adjacent the products 12 in order to feel the products being displayed.

The stand may also include a header unit 24 coupled to the top of the stand. The header unit 24 has a portion for coupling the plurality of products thereto in spaced relation. The header unit 24 provides means for fixedly coupling the plurality of products 12 to the header unit 24 so that the spacing being the plurality of products 12 is maintained. The header unit 24 may include a means for displaying at least one of advertising material and product information.

The plurality of products may be fabric swatches 12. The fabric swatches 12 may have a length L1 that is substantially similar to the height H of the stand.

The stand may include a foot 34, 54 positioned at one or both ends of the stand at the bottom 50 thereof. The stand may include a first upright 28 positioned at one end of the stand and a second upright 28, 30 positioned at the opposite end of the stand, with a foot 34, 54 being coupled to at least one of the uprights 28, 30. A cross-bracing mechanism 44, 46, 62 may be positioned between the uprights 28, 30.

A foot 34, 54 may be coupled to each of the first and second uprights 28, 30. The cross-bracing mechanism 44, 46, 62 may be a plurality of supports extending between the first upright 28 and the second upright 28, 30, with one of the supports 46 being positioned at approximately one-half the height H of the stand.

The first upright 28 may be coupled to a foot 34, 54 and the second upright 30 has a height H3 that is shorter than the height H2 of the first upright 28. The second upright 30 is configured for coupling with a separate product stand 20 at a height which is above the bottom 50 of the stand.

The display unit 10 may also include means for displaying product information for each of the plurality of products 64, 66. The means for displaying product information for each of the plurality of products may be a clear plastic sleeve 66 coupled to each of the plurality of products 12. The sleeves 66 may be configured to accept media 64 that assists in describing the product that the sleeve 66 is coupled to.

The stand may have a width W, with a first side 22 of the stand for displaying a first plurality of products 12 and a second side 22 of the stand for displaying a second plurality of products 12. The first side 22 may be substantially one half of the width W of the stand and the second side 22 may be substantially one half of the width W of the stand.

The header unit 24 may include a first outer support 40 and a second outer support 40, with a center support 36 extending longitudinally between the first and second outer supports 40. The header unit 24 may have a first plurality of products 12 coupled to the first outer support 40 and a second plurality of products 12 coupled to the second outer support 40.

The plurality of products 12 may extend from substantially the top end to the vicinity of the bottom end 50 of the stand. The plurality of products 12 may be removable from the stand. The plurality of products 12 may be substantially fixedly coupled to the top of the stand so as to maintain a spaced relation relative to one another during display. The height H of the stand may be about 3 feet, 4 feet, 5 feet, 6 feet, 6.25 feet, 7 feet, or 8 feet tall.

A method for providing a consumer with the touch and feel of an article utilizing a display unit 10 includes providing a display unit 10 that includes a stand, hanging a plurality of products 12 from the stand, and allowing the consumer to position a major portion of their body against the products 12 in order to determine what the product would feel like in use.

The article may be a bedding material and the plurality of products 12 may be fabric swatches. The method may also include providing product information 64, 66 that is coupled to each of the plurality of fabric swatches 12 in order to assist the consumer in purchasing one or more of the plurality of products 12. The method may also include displaying advertising information at a top end 24 of the stand.

The term "major" part of the body means that about half or more of an average sized height body may be positioned under the header unit 24.

The term "substantially," as used herein, is a term of estimation.

While various features of the claimed invention are presented above, it should be understood that the features may be used singly or in any combination thereof. Therefore, the claimed invention is not to be limited to only the specific embodiments depicted herein.

Further, it should be understood that variations and modifications may occur to those skilled in the art to which the claimed invention pertains. The embodiments described herein are exemplary of the claimed invention. The disclosure may enable those skilled in the art to make and use embodiments having alternative elements that likewise correspond to the elements of the invention recited in the claims. The intended scope of the invention may thus include other embodiments that do not differ or that insubstantially differ from the literal language of the claims. The scope of the present invention is accordingly defined as set forth in the appended claims.

What is claimed is:

1. A product display unit for providing the consumer with an opportunity to position a major part of the consumer's body against the product being displayed comprising:

a stand having a height, a length, a top, and a bottom, the stand comprising:

a first substantially vertical support at one end of the product display unit that supports the stand against a surface, with the first vertical support being substantially centrally positioned at one end of the product display unit, a second substantially vertical support at the opposite end of the product display unit that supports the stand against a surface, with the second vertical support being substantially centrally positioned at one end of the product display unit, with the length defined between the first and second supports, at least two cross supports extending lengthwise between the first and second vertical supports to couple the first and second vertical supports together in the vicinity of the top of the stand, said at least two cross supports lying in substantially the same, non-vertical plane, with said at least two cross supports having attachment points associated therewith that are spaced from one another, wherein the attachment points being attachment holes; and a plurality of products having a first end and a second end, a length and a width, with the width defined between the first end and the second end, with said first and second ends being substantially fixedly and non-movably coupled to the at least two cross supports at the attachment points such that the first end is coupled to one of the cross supports and the second end is coupled to the another of the cross-supports and the plurality of products are maintained in spaced relation relative to one another along the length of the stand at the attachment points and normally non-removable, wherein the height of the stand and a spacing between the plurality of products allows the consumer to position a major part of the consumer's body below the top of the stand and adjacent each of the products in order to feel the products being displayed.

2. The product display of claim 1, further comprising a header unit coupled to the top of the stand, said header unit including the at least first and second cross supports, with said header unit providing means for coupling the plurality of products to the header unit so that the spacing between the plurality of products is maintained.

3. The display unit of claim 1, wherein the plurality of products are fabric swatches.

4. The display unit of claim 1, further comprising a foot positioned at the bottom of each of the first and second vertical supports, with the foot having a length and being oriented substantially perpendicular to the length of the stand.

5. The display unit of claim 4, further comprising a cross-bracing mechanism positioned between the vertical supports, said cross-bracing mechanism being at an angle that is parallel, not parallel, or not perpendicular to a surface against which the stand rests.

6. The display unit of claim 5, wherein the cross-bracing mechanism is a plurality of supports extending between the first vertical support and the second vertical support, with one of the supports being positioned at approximately one-half the height of the stand.

7. The display unit of claim 1, further comprising a foot positioned at one end of the stand at the bottom thereof, wherein the first vertical support is coupled to the foot and the second vertical support has a second height that is shorter than the height of the first vertical support, with the second vertical support being configured for coupling with a product unit at the second height which is above the bottom of the stand, and the cross-bracing mechanism includes a bottom, horizontal support and a pair of X-shaped braces that extend between the bottom and top of the stand.

8. A product display unit for providing the consumer with an opportunity to position a major part of the consumer's body against the product being displayed comprising:

a stand having a height, a length, a top, and a bottom, the stand comprising:

a first substantially vertical support at one end that supports the stand against a surface, a second substantially vertical support at the opposite end that supports the stand against a surface, with the length defined between the first and second supports, at least two cross supports extending lengthwise between the first and second vertical supports to couple the first and second vertical supports together in the vicinity of the top of the stand, said at least two cross supports lying in substantially the same, non-vertical plane, with said at least two cross supports having attachment points associated therewith that are spaced from one another; and a plurality of products having a first end and a second end, a length and a width, with the width defined between the first end and the second end, with said first and second ends being substantially fixedly and non-movably coupled to the at least two cross supports at the attachment points such that the first end is coupled to one of the cross supports and the second end is coupled to the another of the cross-supports and the plurality of products are maintained in spaced relation relative to one another along the length of the stand at the attachment points and normally non-removable or movable, wherein the height of the stand and a spacing between the plurality of products allows the consumer to position a major part of the consumer's body below the top of the stand and adjacent each of the products in order to feel the products being displayed, further comprising a header unit coupled to the top of the stand, said header unit including the at least first and second cross supports, with said header unit providing means for coupling the plurality of products to the header unit so that the spacing between the plurality of products is maintained, wherein the header unit comprises a rectangular member that includes the at least two cross supports and includes a means for displaying at least one of advertising material and product information.

9. The display unit of claim 1, further comprising means for displaying product information for each of said plurality of products, with the means being at least one of coupled directly to each of the plurality of products and positioned adjacent each of the respective plurality of products.

10. The display unit of claim 9, wherein the means for displaying product information for each of said plurality of products is a clear plastic sleeve coupled to each of said plurality of products, with the sleeves being configured to accept media that assists in describing the product that the sleeve is coupled to.

11. The display unit of claim 1, wherein the stand has a width with a first side for displaying a first plurality of products and a second side for displaying a second plurality of products, with the first side being substantially one half of the width of the stand and the second side being substantially one half of the width of the stand.

12. A product display unit for providing the consumer with an opportunity to position a major part of the consumer's body against the product being displayed comprising:

a stand having a height, a length, a top, and a bottom, the stand comprising:

a first substantially vertical support at one end that supports the stand against a surface, a second substantially vertical support at the opposite end that supports the stand against a surface, with the length defined between the first and second supports, at least two cross supports extending lengthwise between the first and second vertical supports to couple the first and second vertical supports together in the vicinity of the top of the stand, said at least two cross supports lying in substantially the same, non-vertical plane, with said at least two cross supports having attachment points associated therewith that are spaced from one another; and a plurality of products having a first end and a second end, a length and a width, with the width defined between the first end and the second end, with said first and second ends being substantially fixedly and non-movably coupled to the at least two cross supports at the attachment points such that the first end is coupled to one of the cross supports and the second end is coupled to the another of the cross-supports and the plurality of products are maintained in spaced relation relative to one another along the length of the stand at the attachment points and normally non-removable or movable, wherein the height of the stand and a spacing between the plurality of products allows the consumer to position a major part of the consumer's body below the top of the stand and adjacent each of the products in order to feel the products being displayed, further comprising a header unit coupled to the top of the stand, said header unit including the at least first and second cross supports, with said header unit providing means for coupling the plurality of products to the header unit so that the spacing between the plurality of products is maintained, wherein the header unit includes a first outer cross support and a second outer cross support, with a center cross support extending longitudinally between the first and second outer cross supports, and with a first plurality of products coupled between the first outer cross support and the center cross support, and a second plurality of products coupled between the second outer cross support and the center cross support.

13. The display unit of claim 1, wherein the plurality of products extend from substantially the top end to the vicinity of the bottom end of the stand.

14. The display unit of claim 1, wherein the plurality of products are non-removable from the stand during normal use, but removable for cleaning or replacement purposes.

15. The display unit of claim 1, wherein a length of the plurality of products is about 3 feet, 4 feet, 5 feet, 6 feet, 6.25 feet, 7 feet, or 8 feet tall.

16. A display method for providing a consumer with the touch and feel of an article, comprising:

providing the product display unit according to claim 1 that includes the stand having the plurality of products hanging from the stand, with the plurality of products having a length ranging between about 3 feet and about 8 feet that permits the consumer to position a major portion of the consumer's body against the products in order to determine what the product would feel like in use.

17. The display method of claim 16, wherein the article is bedding material, and the plurality of products are fabric swatches.

18. The display method of claim 17, further comprising providing product information that is coupled to each of the plurality of fabric swatches in order to assist the consumer in purchasing one or more of the plurality of products; and providing advertising material on a portion of the display that is separate from the plurality of products.

19. A product display for providing the consumer with an opportunity to position a major part of the consumer's body against the product being displayed comprising:

a stand having a height, a length, a top, and a bottom, with a single first substantially centrally positioned vertical upright positioned at one end of the stand and a single second substantially centrally positioned vertical upright positioned at the opposite end of the stand such that the length of the stand is defined between the first and second vertical uprights, a first cross-support attached to the first upright at one end and the second upright at the other end and extending longitudinally along the length of the stand between the first upright and the second upright in the vicinity of the top of the stand; and at least one second cross-support extending parallel and spaced from the first cross-support in one of substantially the same non-vertical plane or substantially the same horizontal plane, with each of the first and second cross-supports having attachment points that are spaced from one another, wherein the attachment points being attachment holes;

a plurality of products having a length and a width, with the width of each of the products extending between the first cross-support and the second cross-support, said products being fixedly maintained in spaced relation from one another along the length of the stand and coupled to the cross-supports at the attachment points, wherein a height of the stand and a spacing between the plurality of products allows the consumer to position a major part of the consumer's body below the first and second cross-supports of the stand and adjacent each of the products in order to feel the products being displayed.

20. The display unit of claim 1, wherein the attachment points permit the plurality of products to be angled relative to the first and second uprights.

21. The display unit of claim 1, further comprising a first end beam coupled in the vicinity of one end of the at least two cross-supports and a second end beam coupled in the vicinity of the other end of the at least two cross-supports, with the products being coupled directly to the at least two cross-supports.

* * * * *